US006401437B1

(12) United States Patent
Kono

(10) Patent No.: US 6,401,437 B1
(45) Date of Patent: Jun. 11, 2002

(54) WEIGHING AND PACKAGING SYSTEM

(75) Inventor: Katsuaki Kono, Shiga (JP)

(73) Assignee: Ishida Co. Ltd., Kyoto (JP)

( * ) Notice: Subject to any disclaimer, the term of this patent is extended or adjusted under 35 U.S.C. 154(b) by 171 days.

(21) Appl. No.: 09/592,259

(22) Filed: Jun. 12, 2000

(30) Foreign Application Priority Data

Jun. 22, 1999 (JP) ..... 11-175307

(51) Int. Cl.[7] ..... B65B 1/32
(52) U.S. Cl. ..... 53/502
(58) Field of Search ..... 53/502, 58, 501, 53/551; 177/25.11, 50, 91

(56) References Cited

U.S. PATENT DOCUMENTS 4,549,618 A * 10/1985 Kono ..... 177/25
4,992,929 A * 2/1991 Yamada et al. ..... 364/189

FOREIGN PATENT DOCUMENTS

CH 630018 5/1982
EP 103475 3/1984
EP 327514 8/1989

* cited by examiner

*Primary Examiner*—John Paradiso
(74) *Attorney, Agent, or Firm*—Shinjyu Global IP Counselors, LLP

(57) ABSTRACT

A device 1 includes the weighing device 110 for weighing articles, the packaging device 120, and a control device 50. The packaging device 120 produces bags from a film, and packages in the bags the articles which have been weighed by the weighing device 110. The control device 50 determines the size of a bag to be produced in the packaging device 120 based on the weight data of the articles sent from the weighing device 110. The weighing and packaging device 1 reduces a burden for an operator and/or time required to perform normal weighing and packaging processes, as well as other special processes such as a zero point calibrating process and an all-drain process. The device 1 can produce bags having a size that is adjusted to the amount of articles being packaged during special processes, when the amount of articles to be packaged tend to vary.

22 Claims, 14 Drawing Sheets

WEIGHING AND PACKAGING SYSTEM

BACKGROUND OF THE INVENTION

1. Field of the Invention

This invention relates to a weighing and packaging system. More specifically, the present invention relates to a weighing and packaging system for weighing and packaging articles.

2. Background Information

There are many kinds of articles of which a predetermined weight or amount is packed in a bag, circulated and sold. Examples of such good include confectionery, fruit and vegetables, daily dishes, dried noodle, and processed food. In general, such articles are first weighed by a weighing device such that a predetermined amount of the articles is taken, and then put in a bag using a packaging device. A system for carrying out weighing and packaging of such articles mainly includes a weighing device and a packaging device. The weighing device performs a combination calculation that calculates combination of two or more weights or numbers of articles to obtain a predetermined weight or number of articles. The packaging device produces a bag from a film and puts into the bag the articles, which has been adjusted to be the predetermined amount by the weighing device.

One example of such system for weighing and packaging (hereinafter referred to as a weighing and packaging system) and devices used for previous and subsequent processes thereof are shown in FIG. 1. In this system, articles are first conveyed to a position above a weighing device 110 by a conveyer device 101. Then the articles are placed on a dispersion feeder 111 and dispersed radially by virtue of the vibration of the dispersion feeder 111. The articles are supplied to a plurality of pool hoppers 113, and temporally pooled therein. The pool hoppers 113 are circumferentially disposed via radially-extending troughs 112 connected to the dispersion feeder 111. After that, the articles are put into weighing hoppers 114, which are disposed below the respective pool hoppers 113. The weight of the articles put in the weighing hoppers 114 is measured by a load cell (a weight detection device) provided with each of the weighing hopper 114. Then, calculation is performed to determine what combination of weighing hoppers 114 should be discharged to obtain a combination weight or amount within an allowable limit, based on the measured weight of amount of articles in each weighing hopper 114. Based on this calculation, the designated weighing hoppers 114 discharge the articles into a discharging shoot 115, as seen in FIG. 2.

On the other hand, a packaging device 120 disposed below the weighing device 110 is a device which fills a bag with the articles discharged from the weighing device 110 while producing bags. The main structure of the packaging device 120 is shown in FIG. 3. This structure is a so-called vertical type pillow packaging device. In this packaging device 120, a sheet type film Fm, which is supplied from a film roll 128 shown in FIG. 1, is formed into a cylindrical shape by a former 121 and a tubular portion 122. The film is then sent downwardly by a pull-down belt mechanism 125. Then, the overlapping vertical edges of the cylindrically formed film Fmc, are heat-sealed by using a vertical seal 123. After the weighed articles are filled in the cylindrical film Fmc through the tubular portion 122, an upper end of a bag and a lower end of a subsequent bag are transversely sealed at the same time by a transverse sealing mechanism 124, which is disposed below the tubular portion 122. At the same time, the center of the transversely sealed portion is cut by a cutter attached to the transverse sealing mechanism 124.

As seen in FIG. 3, a bag B which is filled with the articles is transferred to a conveyer 130 through an inclined guiding plate 129, and conveyed to a weight checker 140, which is used for a subsequent weight-checking process.

In the above-mentioned weighing and packaging system, bags of a predetermined size are automatically manufactured so that articles may be sequentially packaged during normal operation. In order to synchronize the timing of discharging the articles whose weight have been measured by the weighing device with the timing of packaging the articles by the packaging device, a timing signal, which is an ON/OFF signal, is exchanged between controllers of the both devices. Also, a system is present which transmits an error signal, which is an ON/OFF signal, from the controller of the weighing device to the controller of the packaging device when an error is detected in the weighing device.

However, the weighing device and the packaging device are separate devices having different functions. Therefore, no consideration has been made to make the two devices work together except for the exchange of signals such as timing signals and error signals, which is the minimum requirement for both devices to perform normal operation.

When the measurement by the weight hoppers has become inaccurate due to debris from articles attached to the weight hoppers and consequently defective products are detected one after another at the weight checker in the subsequent process, or when the kind of articles has been changed, it is necessary to carry out a zero point calibrating process while no articles are present in the weighing hoppers. To do so, in order to force discharge of the articles from each of the weighing hoppers, the operation of the packaging device normally needs to be stopped. An inconstant weight or number of articles discharged from the weight hoppers has to be put into bags somehow. This operation has been conventionally performed manually by an operator. Specifically, the packaging device is stopped in a state in which there is a bag whose upper end is unsealed. Then articles discharged during the zero point calibrating process is put in the bag and the upper end of the bag is manually sealed, while checking the quantity of the articles in the bag.

Also, when the calculation for combination cannot be performed because of an introduction of different kinds of articles or lack of articles supplied to a weighting device, it is necessary to perform an all-drain process by which articles in all of the weighing hoppers are discharged. In that process, a bag of normal size (hereinafter referred to as a 'one-bag') or a bag having a length twice as long as that of a normal size bag (hereinafter referred to as a 'double-bag') has been conventionally manufactured to allow all the articles discharged in the all-drain process to be put in the bag regardless of the quantity of the articles discharged. Accordingly, if the process is carried out with a double-bag when a one-bag would have been sufficient, a waste of film would result. Conversely, if the process is carried out with a one-bag when a double-bag was in fact necessary to accommodate all the discharged articles, the bag cannot be sealed because of the overstuffing of the articles.

In view of the above, there exists a need for dental instrument which overcomes the above mentioned problems in the prior art. This invention addresses this need in the prior art as well as other needs, which will become apparent to those skilled in the art from this disclosure.

SUMMARY OF THE INVENTION

One of the objects of the present invention is to reduce the burden on an operator and/or time required in performing processes such as the zero point calibrating process and the all-drain process with the weighing device, by coordinating processes of the weighing device with processes of the packaging device. In this manner, the present invention makes the operation of the packaging device efficient and accurate.

According to one aspect of the present invention, a weighing and packaging system includes a weighing device, a packaging device, and a controlling device. The weighing device is adapted to weigh articles and generate weight data of the articles. The packaging device is adapted to produce bags from a film, and package in the bags the articles which have been weighed in the weighing device. The controlling device determines a size of the bags to be produced by the packaging device based on quantity data. The quantity data is calculated from the weight data of the articles. The controlling device sends the size data to the packaging device.

Preferably, the weighing device has a plurality of weighing hoppers for receiving articles. Also, the weighing device carries out a combination operations by selecting a combination of the weighing hoppers based on the weight data of the articles in the weighing hoppers such that a total quantity of the articles in the combination of weighing hoppers is within a predetermined range, and discharges the articles in the combination of weighing hoppers.

Preferably, the controlling device performs a zero point calibrating process. The controlling device during the zero point calibrating process designates which of the weighing hoppers should be emptied and commands a discharge of the articles in the designated weighing hopper. In the mean time, the controlling device determines the size of a bag to be produced by the packaging device based on the quantity data of the articles to be discharged.

Preferably, the controlling device controlling device performs an all-drain process in which the articles in all of said weighing device are discharged. The controlling device during the all-drain process commands a discharge of articles in all of the weighing hoppers. In the mean time, the controlling device determines the size of a bag to be produced by the packaging device based on the quality data of the articles to be discharged.

Preferably, the controlling device performs an error process in which articles in an error weighing hopper are discharged. The controlling device during the error process designates the error weighing hopper and commands a discharge of the articles in the error weighing hopper. In the mean time the controlling device determines the size of a bag to be produced by the packaging device based on the quantity data of the articles to be discharged.

Preferably, the error weighing hopper is a weighing hopper that contains articles beyond the predetermined range.

Preferably, the controlling device determines the size of a bag to be produced in the packaging device based on a target quantity. The target quantity is inputted by an operator.

Preferably, the weighing device has a plurality of weighing hoppers for receiving the articles. The weighing device carries out combination operations based on the weight data of the articles put in the weighing hoppers, selects a combination of the weighing hoppers so that a total quantity of the articles in the combination of weighing hoppers is within a predetermined range including the target quantity, and discharges the articles in the combination of weighing hoppers.

Preferably, the packaging device is adapted to form a film into a cylindrically shaped bag aligned in a substantially vertical direction and having an upper opening, and to seal the upper opening after the articles are filled in the bag. The controlling device determines the vertical length of the bag based on the quantity data.

Preferably, the controlling device includes a first controlling part and a second controlling part. The first controlling part controls the weighing device, whereas the second controlling part controls the packaging device. The quantity data is transmitted from the first control part to the second control part.

Preferably, the quantity data is weight data.

Preferably, the quantity data is volume data calculated based on the weight data and a specific gravity of the articles.

Preferably, the total quantity of the articles is configured in terms of the weight of the articles.

Preferably, the total quantity of the articles is configured in terms of the number of the articles.

According to another aspect of the present invention, a weighing and packaging system includes a weighing device, a packaging device, and a controlling device. The weighing device is adapted to weigh articles and generate weight data of the articles. The packaging device is adapted to produce bags from a film, and package in the bags the articles which have been weighed in the weighing device. The controlling device determines a size of the bags to be produced by the packaging device based on quantity data. The quantity data is calculated from the weight data of the articles. The controlling device sends the size data to the packaging device. The controlling device is arranged to configure the weighing and packaging system in either normal operation state or special operation state.

Preferably, the weighing device has a plurality of weighing hoppers for receiving the articles. The weighing device is arranged to carry out a combination operation while the weighing and packaging system is in said normal operation state. The weighing device during the combination operation selects a combination of the weighing hoppers based on the weight data of the articles in the weighing hoppers so that a total quantity of the articles in the combination of weighing hoppers is within a predetermined range. The weighing device then discharges the articles in the combination of weighing hoppers.

Preferably, the controlling device is arranged to carry out a zero point calibrating process while the weighing and packaging system is in the special operation state. The controlling device during the zero point calibrating process designates which of the weighing hoppers should be emptied, commands a discharge of the articles in said designated weighing hopper to empty said designated weighing hopper, and stores the weight of an empty weighing hopper as a zero point. In the mean time, the controlling device determines the size of a bag to be produced by the packaging device based on the quantity data of the articles to be discharged.

Preferably, the controlling device is arranged to carry out an all-drain process while the weighing and packaging system is in the special operation state. The controlling device during the all-drain process commands a discharge of articles in all of the weighing hoppers to discharge articles in all of the weighing device, and determines the size of a bag to be produced by the packaging device based on the quantity data of the articles to be discharged.

Preferably, the controlling device is arranged to start said all-drain process automatically as said weighing and packaging system meets a predetermined criterion.

Preferably, the controlling device is arranged to start the all-drain process every predetermined period of time.

Preferably, the controlling device is arranged to start an error process while the weighing and packaging system is in the special operation state. The controlling device during the error process articles designates an error weighing hopper, commands a discharge of the articles in the error weighing hopper to discharge articles in the error weighing hopper, and determines the size of a bag to be produced by the packaging device based on the quantity data of the articles to be discharged.

The controlling device is arranged to carry out an all-drain process while the weighing and packaging system is in the special operation state. The controlling device during the all-drain process commands a discharge of articles in all of the weighing hoppers to discharge articles in all of the weighing hoppers, and determines the number of bags having a predetermined size to be produced by the packaging device based on the quantity data of the articles to be discharged.

BRIEF DESCRIPTION OF THE DRAWINGS

Referring now to the accompanying drawings which form a part of this original disclosure.

DETAILED DESCRIPTION OF THE INVENTION

Figure 4:
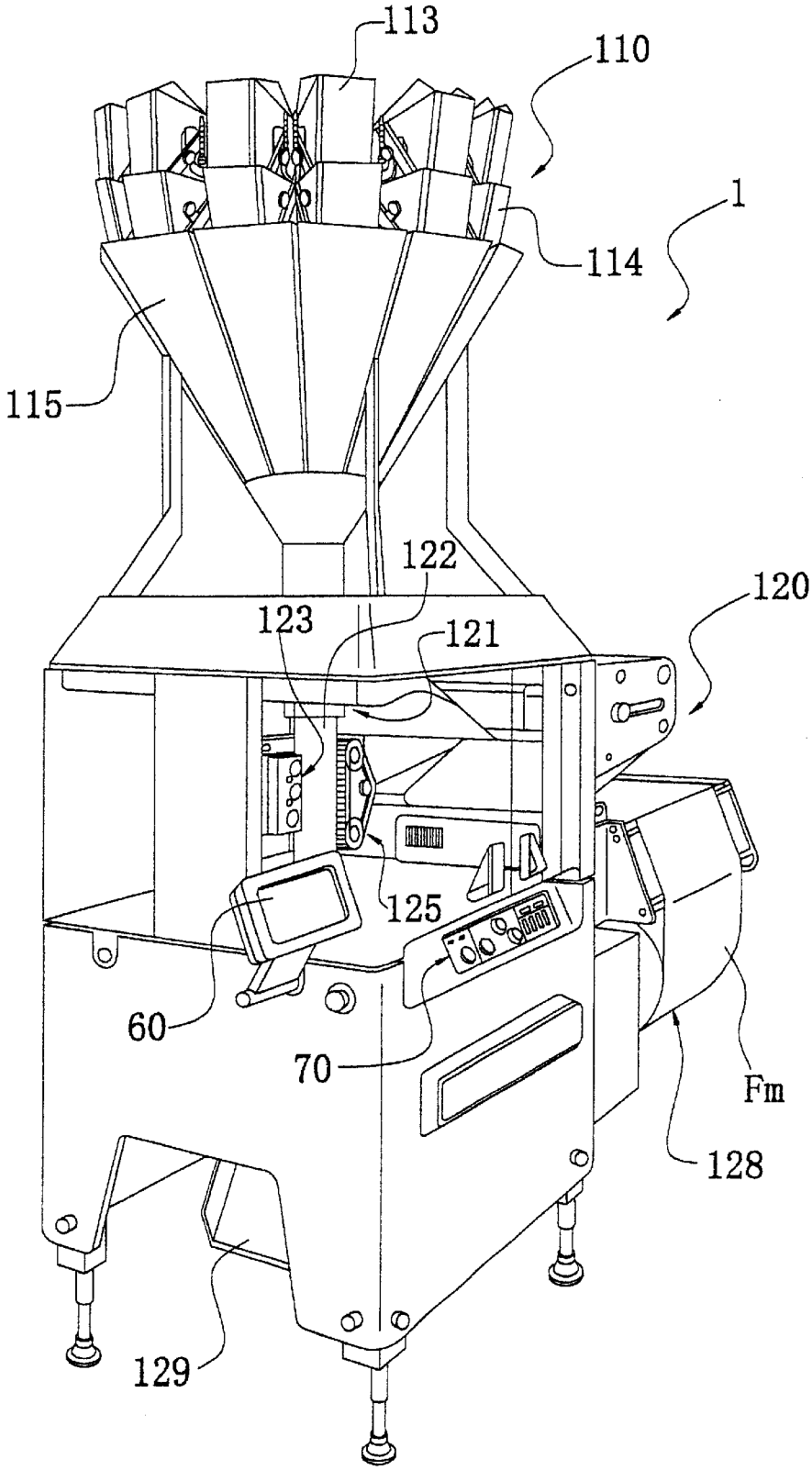
FIG. 4 is a perspective schematic diagram of a weighing—packaging device in accordance with selected embodiments of the present invention.

FIG. 4 shows a weighing—packaging device 1 as the weighing and packaging system in accordance with a first embodiment of the present invention. The weighing—packaging device 1 is a device which combines a weighing device 110 and a packaging device 120 shown in FIG. 1. The device 1 weighs potato chips as an example of articles supplied from a conveyer device 101 shown in FIG. 1, and calculates what combination of potato chips amounts to a weight within a predetermined range. Then, the device 1 packs the chips into bags which are manufactured in a successive manner.

Entire Structure of the Device

Figure 5:
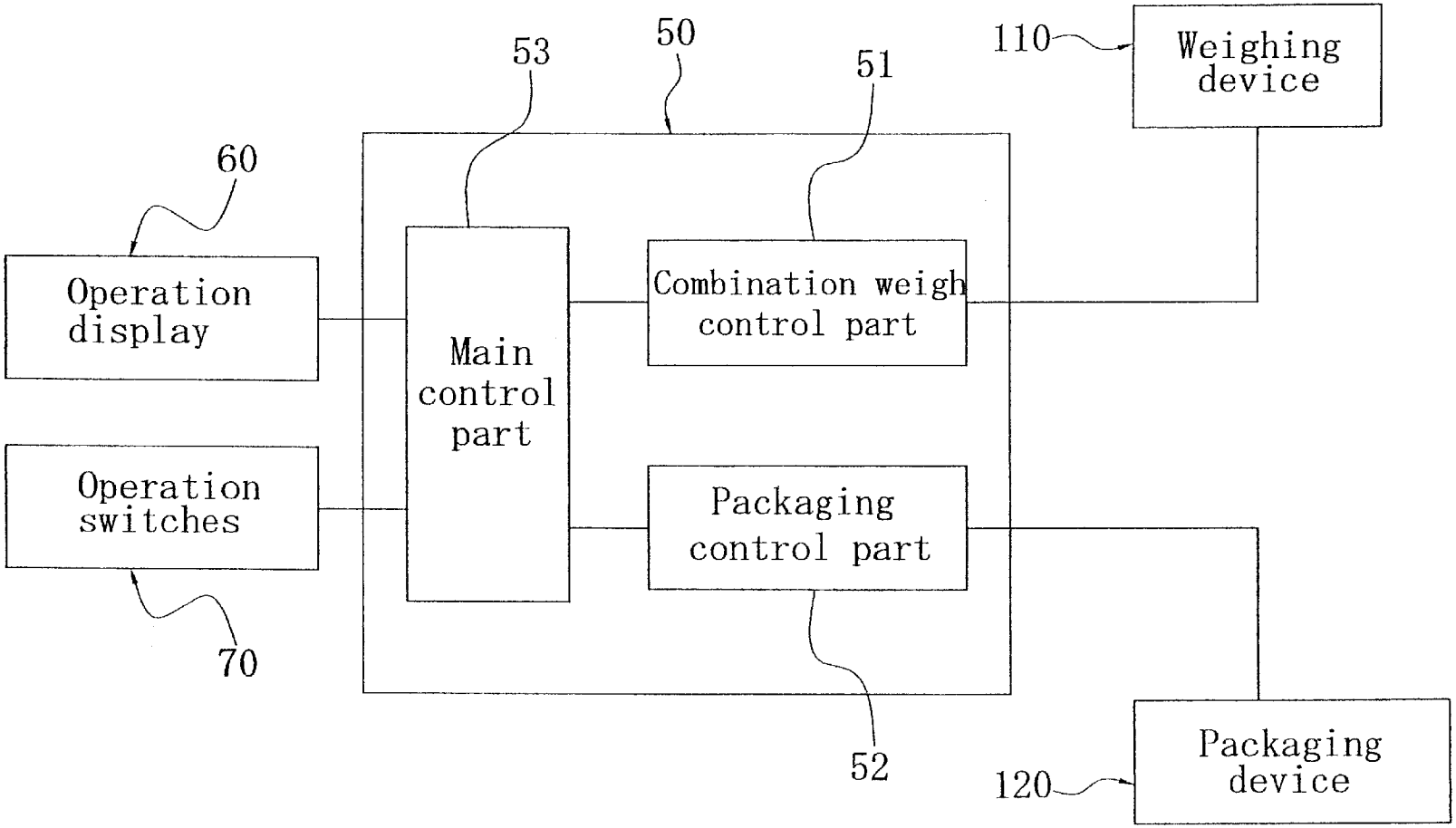
FIG. 5 is a block diagram showing a control of the weighing—packaging device in accordance with selected embodiments of the present invention.

As seen in FIG. 5, the weighing—packaging device 1 includes the weighing device 110, the packaging device 120, and a control device 50 for controlling the devices. Also as seen in FIG. 4, operation switches 70 are disposed on a front side of the device 1. A liquid crystal operation display 60 for displaying the operational status of the device 1 is disposed at a position viewable from an operator who is operating the operation switches 70. A touch panel is provided with the operation display 60 so that the operator can operate the device 1 by touching the operation display 60.

Structure of the Weighing Device

Figure 1:
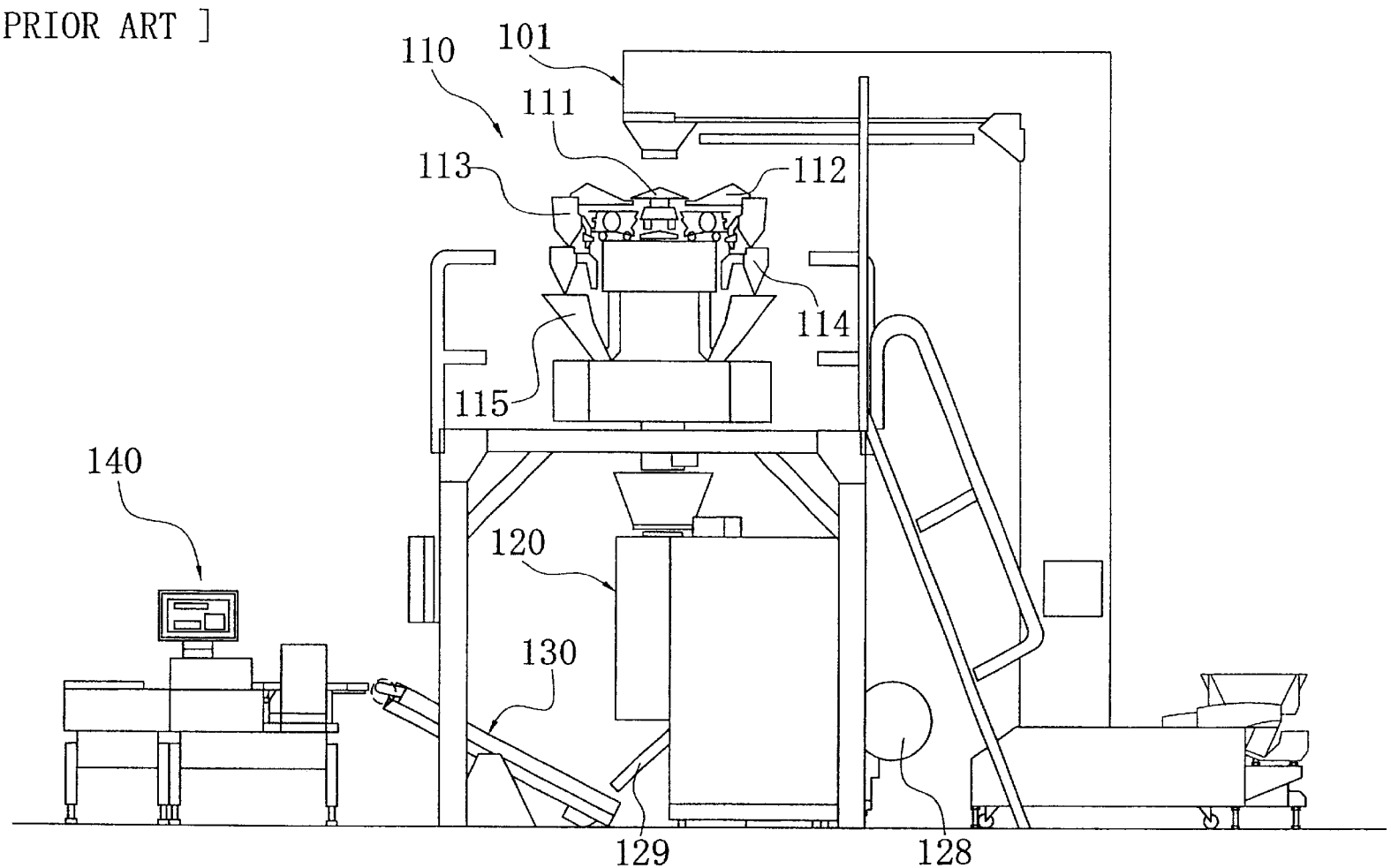
[ PRIOR ART ] Fig. 1
FIG. 1 is a schematic diagram of a weighing and packaging system including a weighing device and a packaging device.
Figure 2:
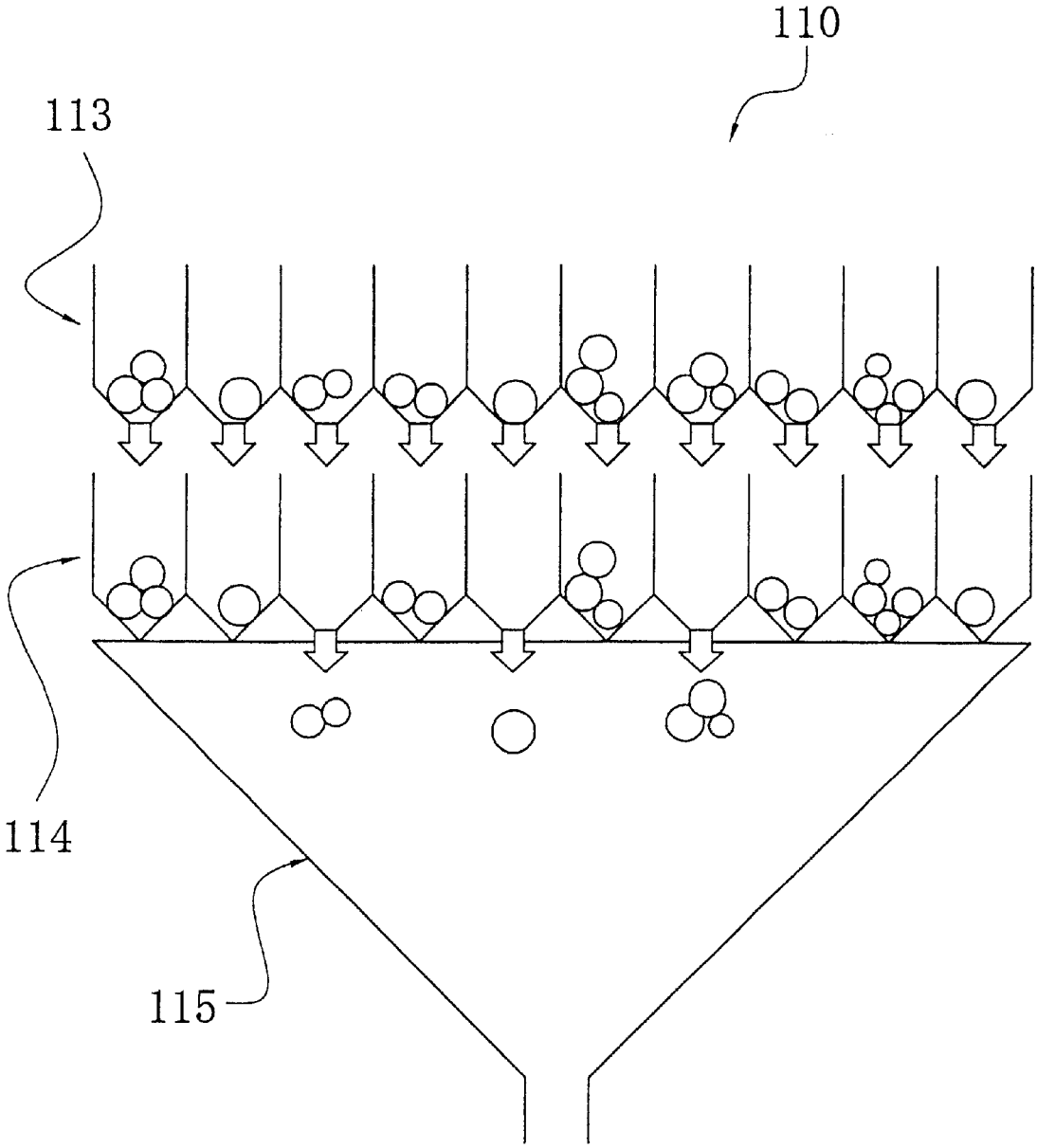
Fig. 2 [ PRIOR ART ]
FIG. 2 is a conceptual diagram of a weighing device.

Since the structure of the weighing device 110 is the same as that of the weighing device 110 shown in FIGS. 1 and 3, the weighing device will now be explained referring to FIGS. 1 and 3.

The weighing device 110 mainly includes a conical dispersion feeder 111, a plurality of radial troughs 112, a plurality of pool hoppers 113 and weighing hoppers 114, and a discharging shoot 115. The dispersion feeder 111 is disposed directly below a position of a conveyer device 101 at which potato chips are supplied. The plurality of radial troughs 112 is circumferentially disposed around the dispersion feeder 111.

The dispersion feeder 111 vibrates when an excitation device is activated, such that the potato chips supplied from the conveyer device 101 onto the upper surface of the dispersion feeder 111 are dispersed and move toward the radial toughs 112 by virtue of the vibration. Each radial trough 112 also vibrates as another excitation device is activated, such that the potato chips move outwardly toward the pool hoppers 113.

The pool hoppers 113 receive the potato chips from the radial troughs 112 to temporally pool them before the chips are sent to the weighing hoppers 114. The pool hoppers 113 supply the potato chips to the weighing hoppers 114 by opening a gate disposed at the bottom upon receiving a signal from a controlling device 50, which will be described later.

Figure 6:
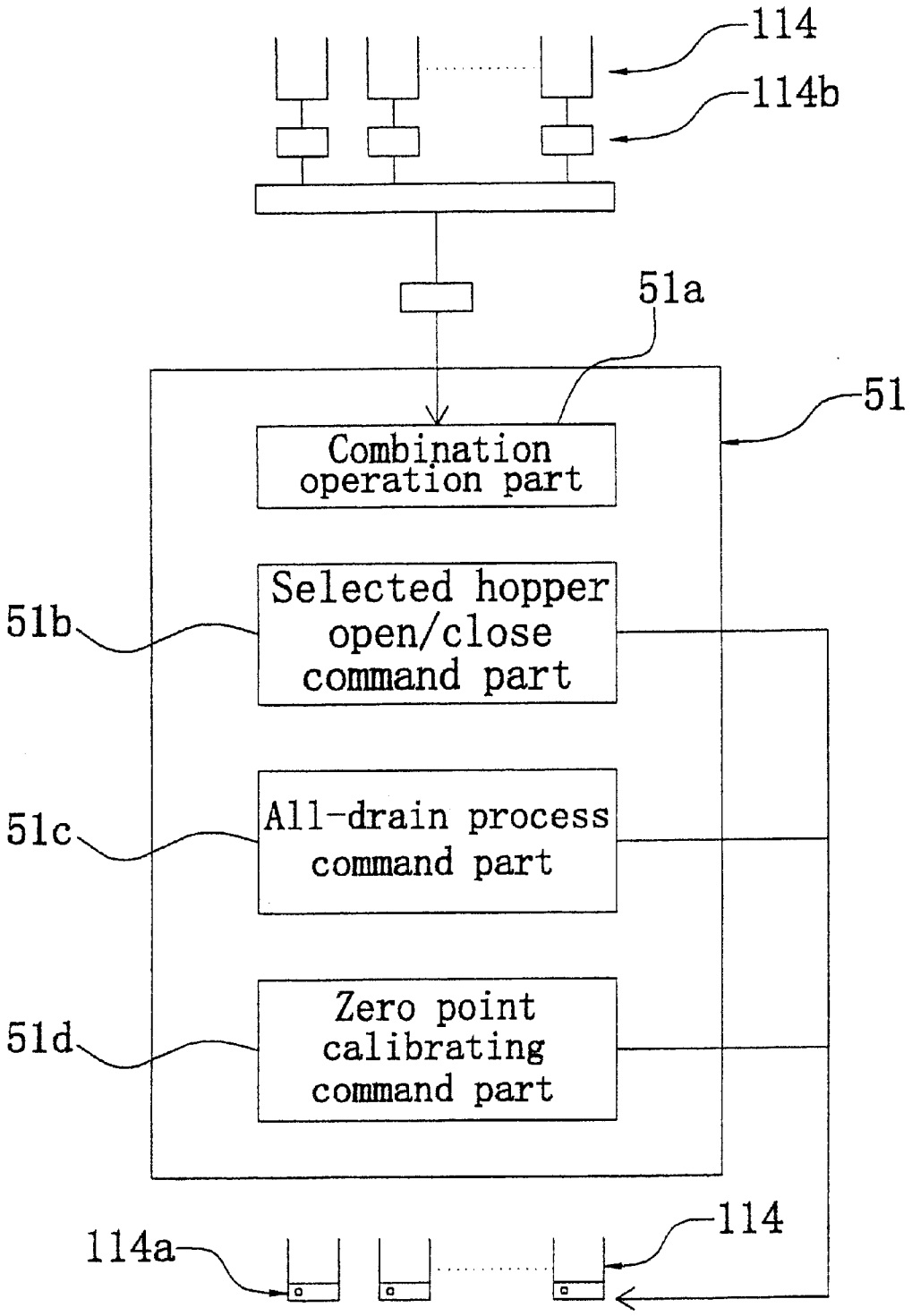
FIG. 6 is a block diagram of a combination weight control part in accordance with selected embodiments of the present invention.

The weighing hoppers 114 are disposed below the pool hoppers 113. Similar to the pool hoppers 113, the plurality of the weighing hoppers 114 is disposed circumferentially, as seen in FIG. 4. Referring to FIG. 6, each of the weighing hoppers 114 has a load cell 114*b* for measuring the weight of potato chips therein, and a gate 114*a* for dropping the potato chips to the discharging shoot 115. The gates 114*a* are disposed at the bottom of the load cells 114.

The discharging shoot 115 collects the potato chips dropped from each of the weighing hoppers 114 and sends them to a tubular portion 122 of a packaging device 120, which will be described later.

Structure of the Packaging Device

The packaging device 120 mainly includes a packaging portion and a film supplying portion. The packaging portion manufactures bags and carries out a heat sealing of an opening portion of a bag after the bag is filled with weighed potato chips. A roll of film 128 is set in the film supplying portion. The roll 128 supplies a film, Fm, of sheet type to a film forming mechanism including a former 121 and a tubular portion 122 of the packaging portion. As seen in FIG. 4, the packaging portion is disposed directly below the weighing device 110. On the other hand, the film supplying portion is disposed adjacent to the packaging portion.

Figure 3:
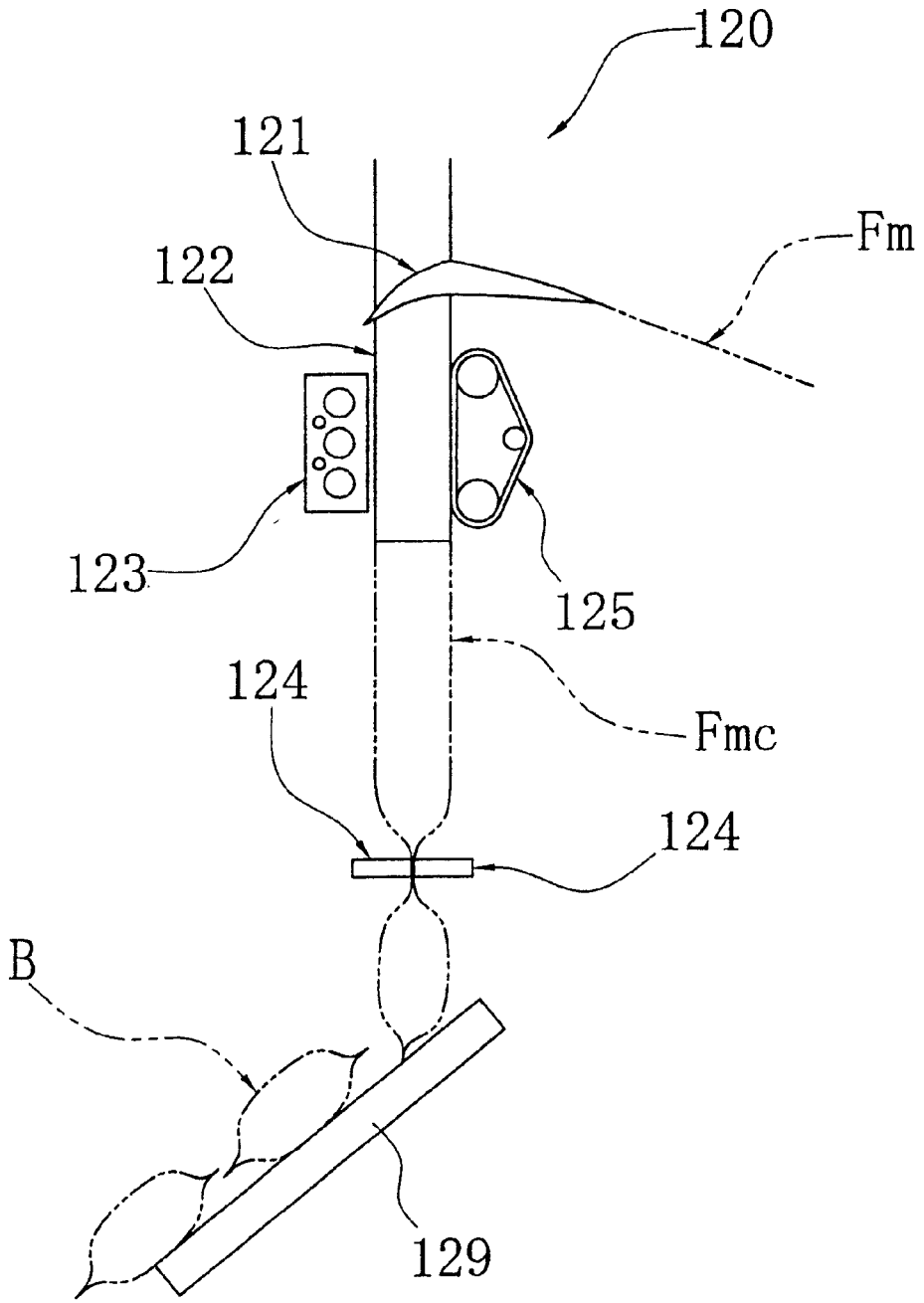
Fig. 3 [ PRIOR ART ]
FIG. 3 is a schematic structural diagram of a packaging device.

Referring to FIG. 3, the packaging portion of the packaging device 120 mainly includes a forming mechanism, a pull-down belt mechanism 125, a vertical sealing mechanism 123, and a transverse sealing mechanism 124. The forming mechanism forms a film sheet into a cylindrical shape. The pull-down belt mechanism 125 conveys the cylindrically shaped film sheet downwardly. The vertical sealing mechanism 123 heat-seals overlapping edges of the cylindrical film. The transverse sealing mechanism 124 seals the upper end of the bag and the lower end of a subsequent bag by transversely sealing the cylindrical film.

Referring to FIG. 4, the forming mechanism mainly includes the former 121 and the tubular portion 122. The tubular portion 122 is a cylindrically shaped member having open upper and lower ends. Potato chips discharged from the weighing device 110 are dropped into the upper opening of the tubular portion 122. The former 121 is disposed so as to surround the tubular portion 122. The shape of the former 121 is so designed that the sheet type film Fm shown in FIG. 3 supplied from film supplying unit is formed into a cylindrical shape as the film passes through from the former 121 to the tubular portion 122.

The pull-down belt mechanism 125 is a mechanism for absorbing the cylindrical film Fm that is wrapped around the tubular portion 122, thereby transferring the film Fm downwardly. The pull-down belt mechanism 125 mainly includes a driving roller, a coupled roller and a belt having the absorbing function.

The vertical sealing mechanism 123 seals overlapping portions of the cylindrical film wrapped around the tubular portion 122 in a vertical direction while pressing the film against the tubular portion 122 with a constant pressure. The vertical sealing mechanism 123 has a heater and a heater belt as the vertical sealing portion. The heater belt is heated by the heater and contacts the overlapping portion of the cylindrical film.

The transverse sealing mechanism 124 is disposed below the forming mechanism, the pull-down belt mechanism 125, and the vertical sealing mechanism 123. The transverse sealing mechanism 124 holds the cylindrical film Fmc between a pair of sealing jaws which rotates in D shape and heat-seals the film by applying heat. Also, the transverse sealing mechanism 124 is provided with a cutter device (not shown in the figure) for cutting a preceding portion of the cylindrical film Fmc, which is now a bag B, from the subsequent bag.

Structure of the Controlling Device

The controlling device 50 performs a total control of the device 1. Referring to FIG. 5, the controlling device 50 includes a combination weight control part 51 for performing a local control of the weighing device 110, a packaging control part 52 for performing a local control of the packaging device 120, and a main controlling part 53 for controlling operation related to both of the devices 110 and 120. The main controlling part 53 transfers information such as timing signals, error signals, and weight data between the control parts 51 and 52. The main controlling part 53 receives input information that an operator inputs via the operation display 60 or the operational switches 70, and displays the status of the device 1 to the operator.

The combination weight control part 51 will now be explained in detail referring to FIG. 6. The combination weight control part 51 is a control sequence or control program that uses a CPU. The combination weight control part 51 includes a combination operation part 51*a*, a selected hopper open/close command part 51*b*, an all-drain process command part 51*c*, and a zero point calibrating process command part 51*d*.

The combination operation part 51*a* receives via an amplifier or a filter a signal of measurement result outputted from the load cell 114*b* which measures the weight of each weighing hopper 114. The signal of measurement result is weight data. Weight data can be the weight of the articles, or figures that correspond to ranges of the weight of the articles. The combination operation part 51 then a performs a combination operation based on the weight of potato chips in each of the weighing hopper 114. Then, the combination operation part 51*a* selects a combination of the weighing hoppers 114 such that the total weight of potato chips in the combination falls within the predetermined range. Based on the selection results, the selected hopper open/close command part 51*b* then transmits an opening/closing signal to the gate 114*a*, which is disposed at the bottom of the weighing hopper 114.

Also, the all-drain process command part 51*c* and the zero point calibrating process command part 51*d* transmit an opening/closing signal to the gate 114*a* at the bottom of the weighing hopper 114, when the operator inputs a command to perform such processes or when the system automatically shifts to the all-drain process upon satisfaction of all of the predetermined conditions, which will be described later.

Since control of the weighing device 110 and control of the packaging device 120 are integrated in the control device 50, an operator may control each of the devices 110 and 120 by operating the control device 50. Therefore, it is easy for an operator to control the processes.

Summary of the Operation of the Device

When potato chips are supplied to the weighing device 110 from the conveyer device 101 connected to a preceding process, the potato chips are dispersed radially from the dispersion feeder 111 due to vibration. The potato chips are then pushed toward the pool hoppers 113 via the radial troughs 112 to be temporally pooled there. After that, the potato chips are put into the weighing hoppers 114 and weighed by the load cell 114*b* provided in each of the weighing hoppers 114. Then, some of the weighing hoppers 114 are selected for combination based on the combination calculation using the results of measurement. The potato chips in the selected weighing hoppers 114 are dropped to the discharging shoot 115, and further sent to the tubular portion 122 of the packaging device 120.

In the mean time, the former 121 and the tubular portion 122 in the packaging device 120 manufacture a cylindrically shaped film Fmc wrapped around a lower portion of the tubular portion 122. As seen in FIG. 3, the film Fmc is sealed in the vertical direction by the vertical sealing mechanism 123. When the potato chips are dropped into the cylindrically shaped film Fmc through the tubular portion 122, the transverse sealing mechanism 124 transversely seals the portion of the film Fmc between two sets of dropping chips. Thereafter, the center of the transversely sealed portion is cut by the cutter attached to the transverse sealing mechanism 124. In this manner, bags B are manufactured in a continuous manner, with each of which being filled with potato chips. As seen in FIG. 1, these bags B are transferred to the conveyer 130 through the inclined guiding plate 129 and conveyed to the weight checker 140 used for a subsequent process.

Detail of Control of Devices

Next, some of the processes of the device 1 will be explained with reference to a screen displayed in the operation display 60 shown in FIG. 11.

Figure 11:
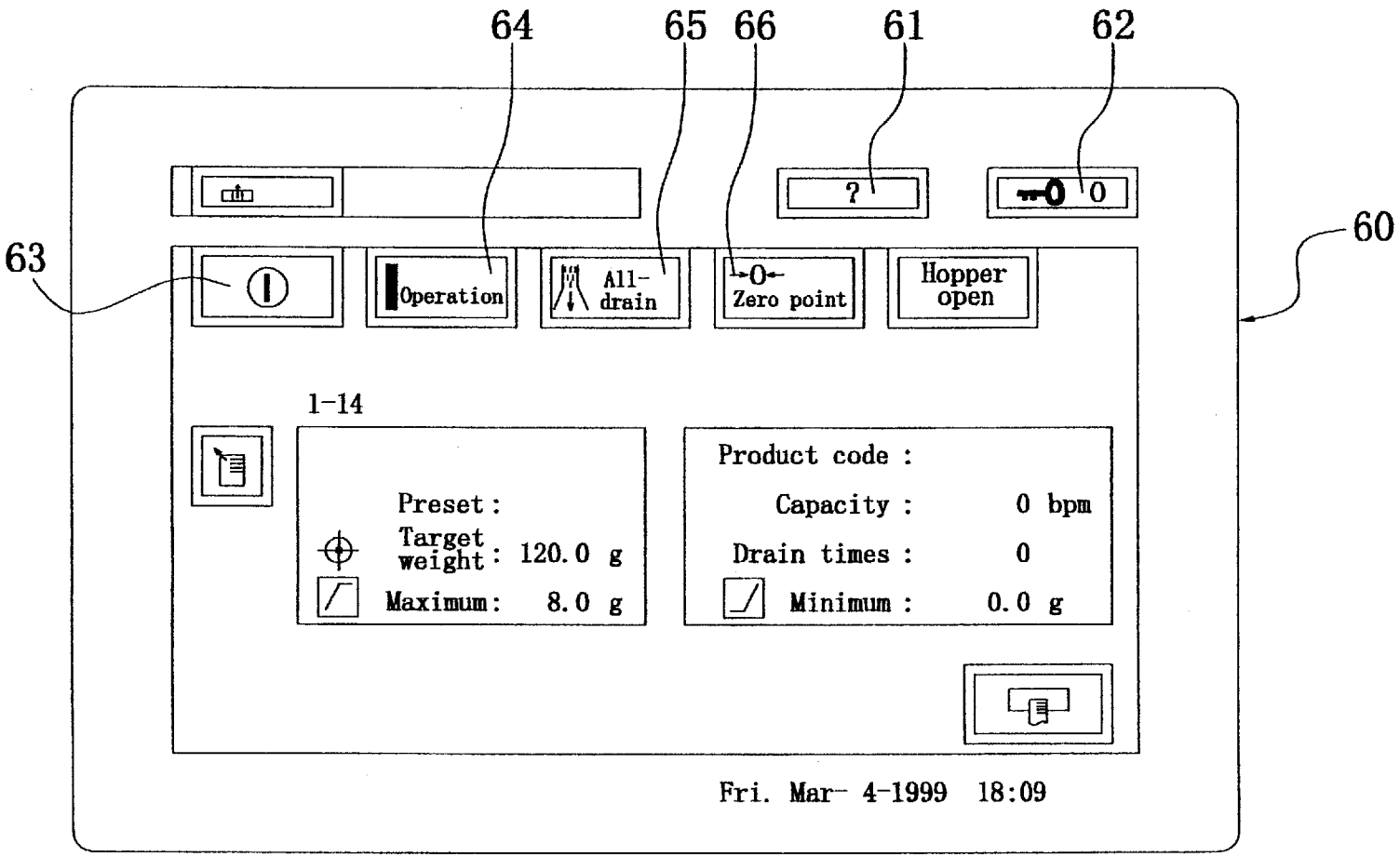
FIG. 11 is a diagram showing a screen of an operation display in accordance with selected embodiments of the present invention.

FIG. 11 shows a normal screen of the operation display 60. Items required for daily operation are displayed in a concentrated manner in the screen. In this case, the screen displays a help key 61, an operational environment setting key 62, a driving portion power key 63, a start key 64, an all-drain key 65, and a zero point adjusting key 66.

(Main Flow)

Figure 7:
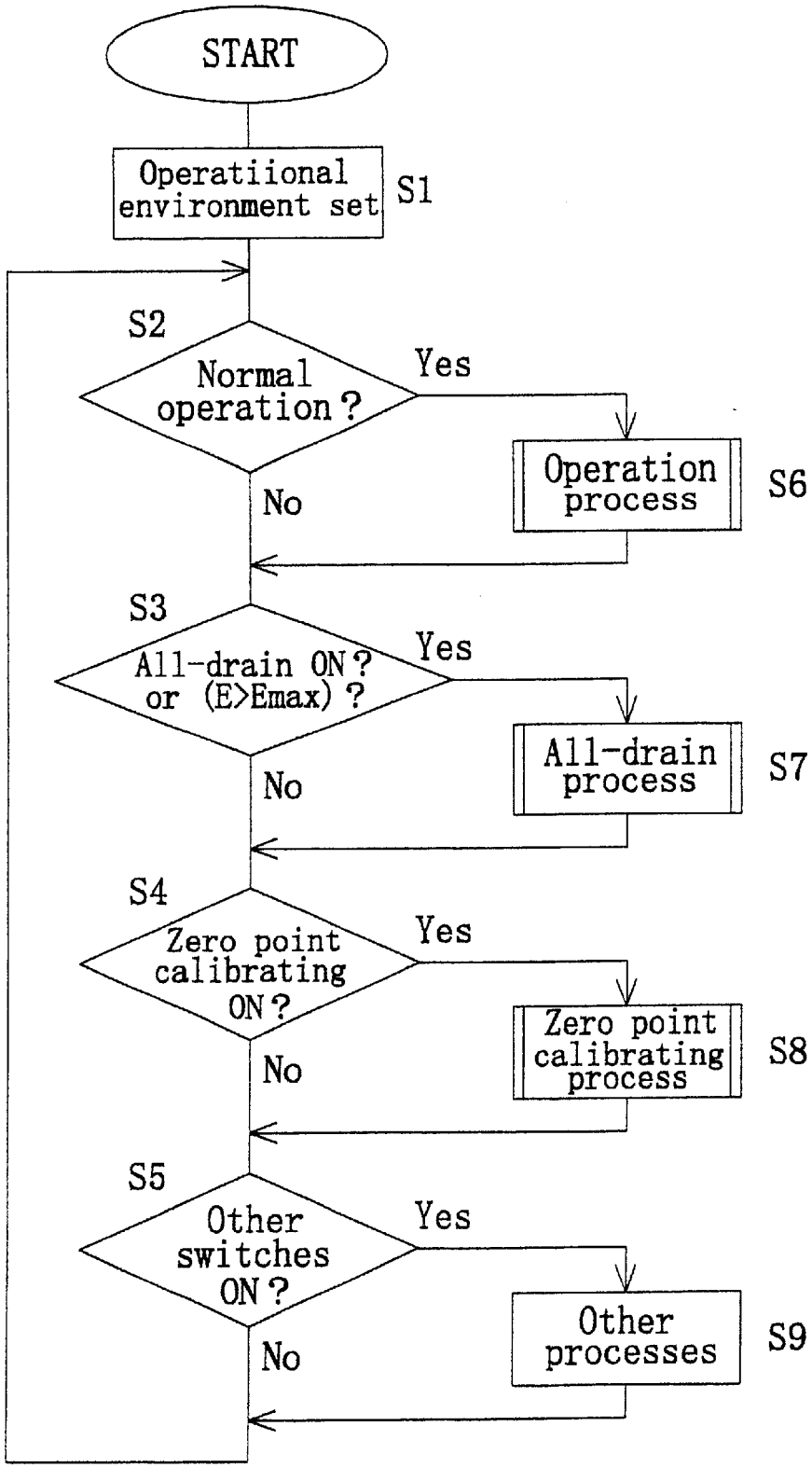
FIG. 7 is a flow diagram of a main control in accordance with selected embodiments of the present invention.

FIG. 7 shows a flow chart of a main control. In step S1, the device 1 configures settings relating to an operational environment, such as a targeted weight value, upper and lower limit values, and a number of discharging operation, in accordance with articles handled. In other words, these settings should be for potato chips in this embodiment. For this purpose, the operator touches the operational environment setting key 62 in the screen shown in FIG. 11 to proceed to a next screen (not shown in the figure) and configure further settings. In this embodiment, once the targeted weight value is set, the vertical length of the bag B to be manufactured in the packaging device 120 is automatically determined in accordance with the weight value.

After the settings in step S1 are completed, the operator determines whether to start the normal operation in step S2. If the start key 64 is pushed and the device is activated in the normal operation state, the normal operation is carried out in step S6. Further, the operator determines whether to start the all-drain operation in step S3. It is also determined in step S3 whether a combination failure accumulation value E, which will be explained later, exceeds a predetermined value $E_{max}$. If the all-drain key 65 was pushed, or the combination failure accumulation value E exceeds the $E_{max}$, the all-drain process is carried out in step S7. Then, if the operator chooses to perform the zero point calibrating process by pushing the zero point adjusting key 66 in step S4, the zero point calibrating process is carried out in step S8. Further, another process is carried out in step S9 if the operator pushes another switch or key in step S5.

(Flow of Normal Operation Process)

Figure 8:
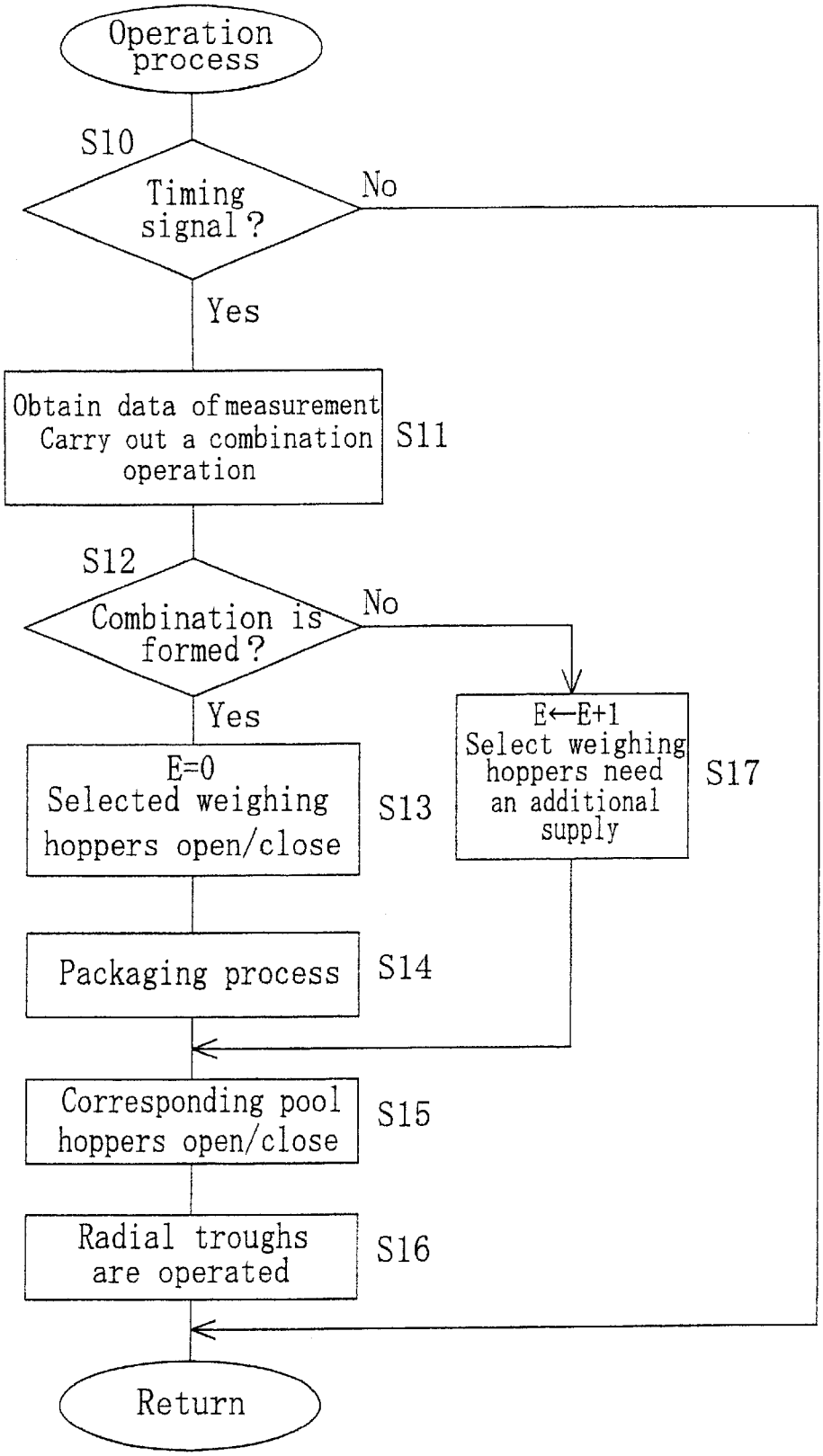
FIG. 8 is a flow diagram of operational processes in accordance with selected embodiments of the present invention.

FIG. 8 shows a flow chart of a normal operation process. Prior to weighing and packaging processes, an operator inputs a target total weight of articles to be packaged. The size of bags produced by the packaging device is automatically determined based on the inputted target total weight. When a timing signal is transmitted from the packaging control part 52 in step S10, the combination operation part 51*a* of the combination weight control part 51 obtains data of measurement results from the load cell 114 to carry out a combination operation in S11. Then, if a combination of predetermined number (for instance, three) of weighing hoppers 114 that makes the total weight of potato chips within a predetermined range including the target total weight is found, it determines that the combination is formed in step S12 and proceeds to a step S13. In step S13, the combination failure accumulation value E is returned to zero. At the same time, the three weighing hoppers 114 which have been selected during the combination operation are opened and closed. More specifically, the selected hopper open/close command part 51*b* sends an open/close command to the gate 114*a* to open the gate 114*a* of the selected weighing hoppers 114. In this manner, the potato chips in the selected weighing hoppers 114 drop to the cylindrically shaped film Fmc through the discharging shoot 115 and the tubular portion 122. After that in step S14, the cylindrically shaped film Fmc, which is now ready to close the potato chips bag, is heat-sealed by the transverse sealing mechanism 124 in the packaging device 120.

In step S15, the pool hoppers 113 located above the weighing hoppers 114 which have discharged the potato chips are opened and closed to supply new potato chips to the weighing hoppers 114. In step S16, the radial troughs 112 are operated to supply new potato chips to the pool hopper 113.

If a combination is not found in the step S12, in other words, if a total weight of the potato chips in any combination fails to fall within the predetermined range, the device 1 proceeds to step S17. In step S17, the combination failure accumulation value E is increased by one. The combination failure accumulation value E is the number of times the formation of combinations failed consecutively. Then, based on the measurement results, it is determined which weighing hoppers need an additional supply of potato chips. Then, it proceeds to the step S15 to open and close the corresponding pool hoppers 113. If a combination is formed in the next combination calculation, the combination failure accumulation value E is returned to zero. However, if a sufficient amount of potato chips is not supplied to the weighing hopper 114 after the dispersion feeder 111, the radial troughs 112 and the pool hoppers 113 conducted supplying operation repeatedly, the combination failure accumulation value E increases accordingly. Finally, if the combination failure accumulation value E exceeds the predetermined value $E_{max}$, it is determined that there is no more supply of potato chips to be supplied to the weighing device 110, and therefore the packaging operation of potato chips cannot be continued. Accordingly, the device 1 automatically proceeds from the step S3 to the all-drain process in step S7.

Conventionally, an operator had to input the size of bags to be produced by the packaging device. In this embodiment, however, the size of bags is determined automatically from the target total weight inputted by the operator. Besides dispensing with an unnecessary step, the present invention is also effective in avoiding problems that occur due to input mistakes.

(Flow of the All-drain Process)

Figure 9:
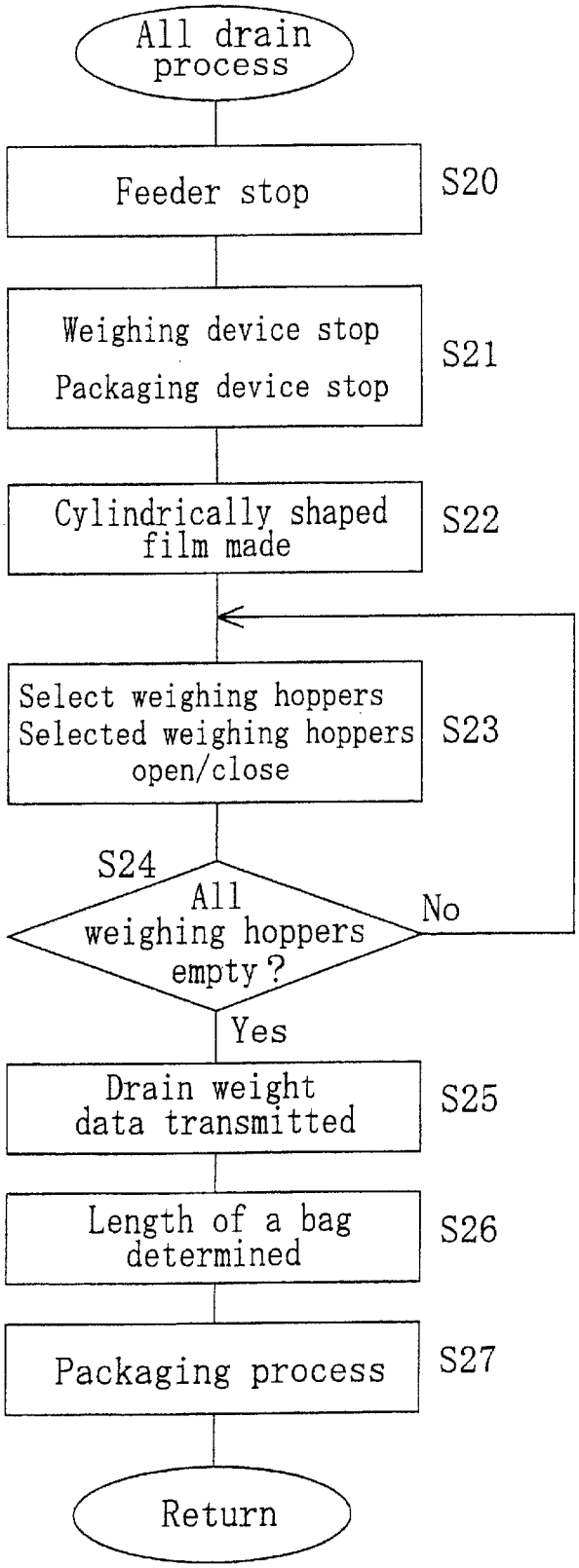
FIG. 9 is a flow diagram of an all-drain process in accordance with selected embodiments of the present invention.

When the all-drain key 65 is pushed by the operator, or when the combination failure accumulation value E has exceeded the predetermined value $E_{max}$, the process proceeds to the step S7 from the step S3 to conduct the all-drain process shown in FIG. 9. In the all-drain process, all of the weighing hoppers 114 are forced to open, three at a time. Accordingly, potato chips in all of the weighing hoppers 114 are discharged and packed in a bag.

Upon starting the all-drain process, the dispersion feeder 111 and the radial troughs 112 are stopped in step S20. Then, the weighing operation by the weighing device 110 and the packaging operation by the packaging device 120 are stopped in step S21.

After that, a cylindrically shaped film to be used for packaging the all-drained potato chips is prepared by the packaging device 120 in step S22, so that the potato chips that are compulsorily discharged can be discarded easily. This preparation of cylindrically shaped film is stopped in a state in which the lower end of the bag is transversely sealed but its upper end is open, such that articles discharged from the weighing device may be dropped into the cylindrically shaped bag through the upper opening. Accordingly, a bag of a suitable size for the amount of the articles may be produced by changing the length of the bag.

Next, in step S23, three of the weighing hoppers 114 are selected to discharge the potato chips therefrom. The process in the step S23 is repeated until it is determined in step S24 that all of the weighing hoppers 114 are empty.

After all of the weighing hoppers 114 become empty, data of the total weight of the discharged potato chips are transmitted to the packaging control part 52 from the combination weight control part 51 via the main controlling part 53 in step S25. In step S26, the packaging control part 52 determines the length of a bag necessary for packing all the potato chips to be discarded, based on the total weight of the discharged potato chips.

Then, in step S27, the packaging device 120 transversely seals the cylindrically shaped film so that the determined length of the bag is secured and the compulsorily discharged potato chips are all packed in the bag.

In the all-drain process, the articles in the weighing hoppers are discharged compulsorily. Therefore, the amount of the articles discharged to the packaging device from the weighing device is not always within the predetermined range. In this case, however, since the size of a bag is determined by using the total weight of the articles, there is no need for an operator to determine the size of a bag while watching the amount of articles being discharged.

Figure 12:
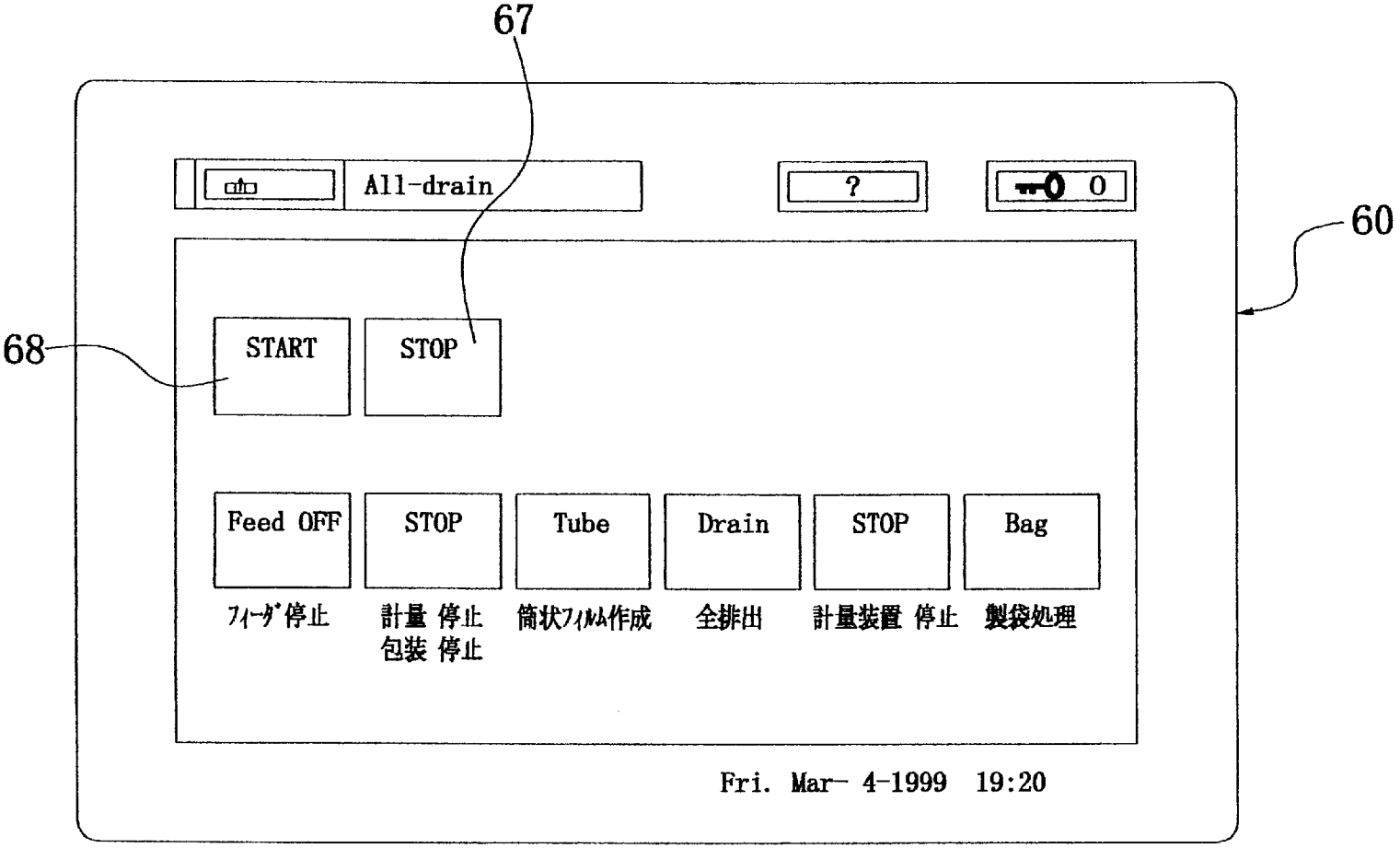
FIG. 12 is a diagram showing a screen of the operation display during the all-drain process in accordance with selected embodiments of the present invention.

Note that since a screen shown in FIG. 12 is displayed on the operation display 60 while the all-drain process is carried out, the operator can monitor the progress of the process. Also, the operator may stop the process by pushing the stop key 67, and restart the process by pushing the start key 68.

(Flow of the Zero Point Calibrating Process)

Figure 10:
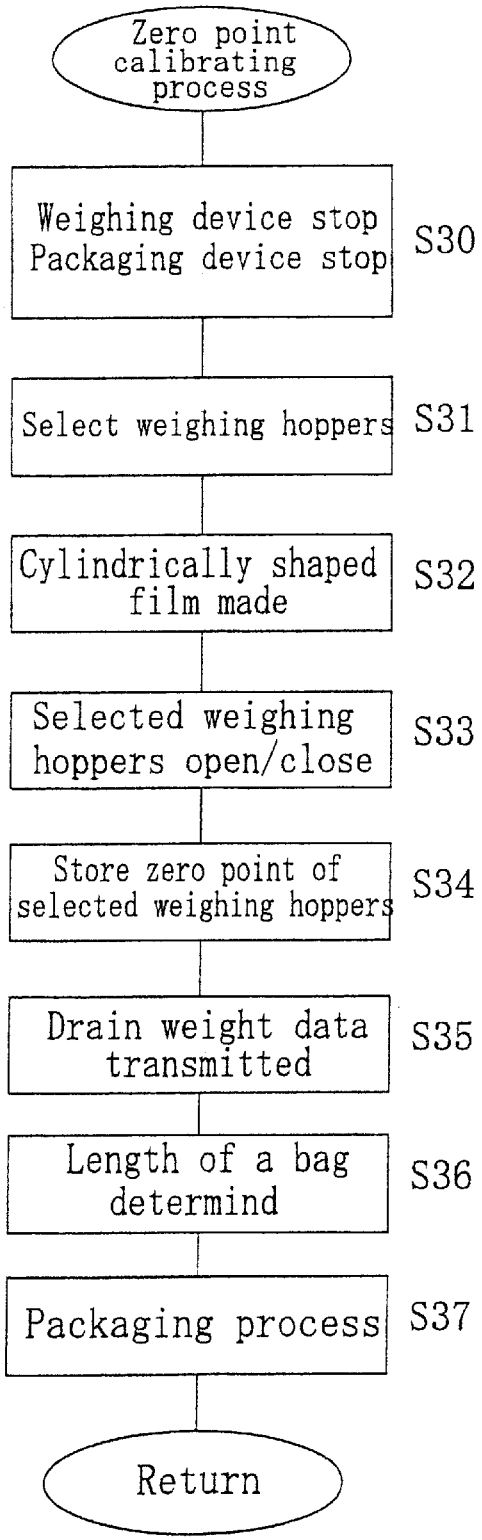
FIG. 10 is flow diagram of a zero point calibrating process in accordance with selected embodiments of the present invention.

When the zero point adjusting key 66 is pushed by the operator, the process goes to step S8 from the step S4, and the zero point calibrating process shown in FIG. 10 starts. In the zero point calibrating process, potato chips in the weighing hopper 114 selected by the operator are compulsorily discharged in order to empty the weighing hopper 114. The weight of the empty weighing hopper is stored as a renewed zero point.

Upon entering the zero point calibrating process, in step S30, the weighing operation of the weighing device 110 and the packaging operation of the packaging device 120 are stopped.

Then, a screen for selecting weighing hopper 114 (not shown) is displayed on the operation display 60 in step S3 1, so that the operator can select weighing hoppers 114 on which the operator wishes to perform the zero point adjustment. In the mean time, a cylindrically shaped film to be used for packaging is prepared by the packaging device 120 in step S32, so that the potato chips compulsorily discharged may be easily discarded. The preparation of the cylindrically shaped film is stopped in a state in which its lower end is transversely sealed but its upper end is open.

Next, as one or a plurality of the weighing hoppers 114 is selected by the operator in the step S3 1, potato chips are discharged from the selected weighing hoppers 114 in step S33. Then, the weight of the empty weighing hopper 114 obtained at this time is stored as a renewed zero point in step S34.

In step S35, data of the total weight of the discharged potato chips are sent to the packaging control part 52 from the combination weight control part 51 via the main controlling part 53. At this time, the packaging control part 52 determines the vertical length of a bag necessary for packing all the potato chips to be discarded, based on the total weight of the discharged potato chips. In the zero point calibrating process, the articles in the weighing hoppers that are subjected to the process are discharged compulsorily. Therefore, the amount of the articles discharged to the packaging device from the weighing device is not always within the predetermined range. In this case, however, since the size of a bag is determined based on the total weight of the articles, there is no need for an operator to determine the size of a bag while watching the amount of articles being discharged.

Then, the packaging device 120 transversely seals the cylindrically shaped film in step S37, so that the determined length of the bag is secured and the compulsorily discharged potato chips are packed in the bag.

Figure 13:
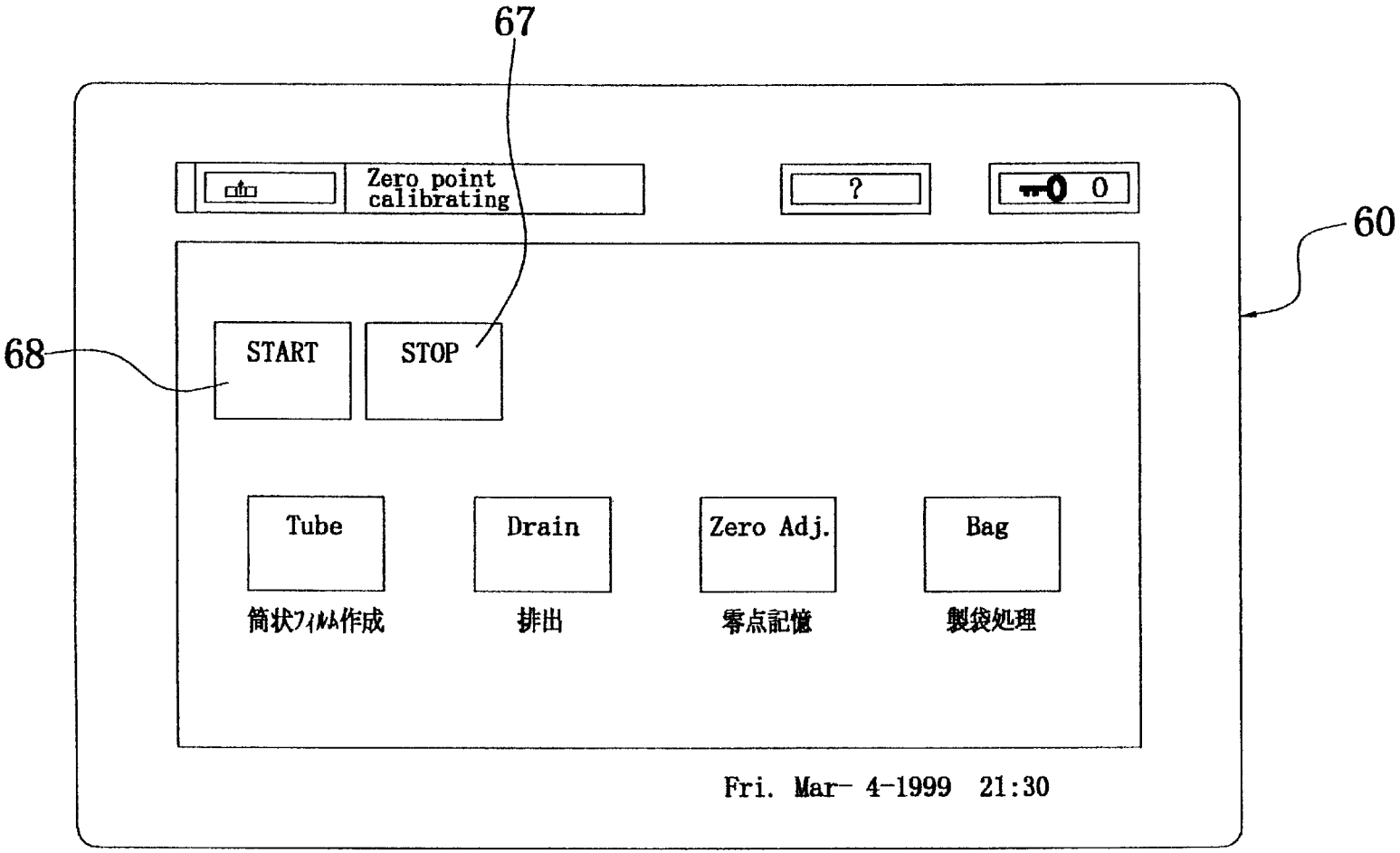
FIG. 13 is a diagram showing a screen of the operation display during the zero point calibrating process in accordance with selected embodiments of the present invention.
Figure 14:
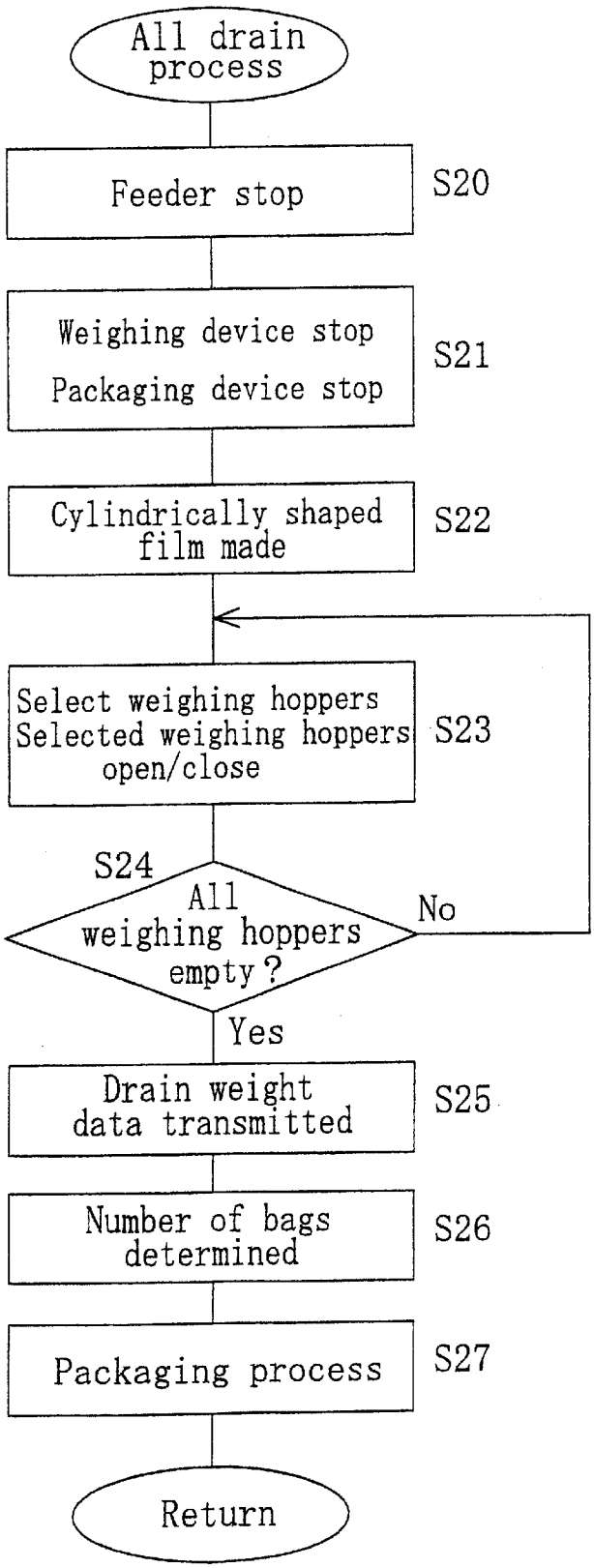
FIG. 14 is a flow diagram of an all-drain process in accordance with a third embodiment of the present invention

Note that since a screen shown in FIG. 13 is displayed on the operation display 60 while the zero point calibrating process is carried out, the operator can monitor the progress of the process. Also, the operator may stop the process by pushing the stop key 67, and restart the process by pushing the start key 68.

Characteristics of the Device (1)

The device 1 of the present invention determines the vertical length of a bag based on the weight of the potato chips to be put in the bag. Accordingly, the vertical length of a bag to be used in the all-drain process or the zero point calibrating process is determined based on the total weight of potato chips compulsorily discharged during the process. Therefore, the discharged potato chips can be packed in a bag that is adjusted to the amount of the potato chips. Accordingly, a conventional operation in which an operator determines the vertical length of a bag by watching the discharged amount may be omitted with the device 1 of the present invention. Hence, the all-drain process or the zero point calibrating process can be performed in a more efficient manner.

The manner of determining the length of a bag may be modified. The device may choose between a normal size bag or a bag twice the size of the normal size bag. The device may also determine the vertical length by making the length proportional to the amount of discharge, or by selecting from several choices of bags that have different lengths. Also, in order to be easily distinguished from the bags manufactured in the normal operation mode, it is possible to make the length of a bag for use in the all-drain process or the zero point calibrating process different from that of the normal size bag. In such case, it is possible to tell the bags for discarding from normal bags without having to check the weight of the bags. Therefore, it is easier to dispose of bags produced in the all-drain process or the zero adjusting process.

(2)

According to the device 1 of the present invention, the control of the weighing device 110 and the control of the packaging device 120 are performed in an integrated manner. For this reason, the operator can control the weighing device 110 and the packaging device 120 separately from the operation display 60 and operation switches 70. Moreover, the operator can also perform the all-drain process and the zero point calibrating process , which require operations of both the weighing device 110 and the packaging device 120, from the operation display and operation switches 70 very easily.

(3)

The device 1 of the present invention automatically starts the all-drain process if an additional supply of potato chips is provided from the pool hoppers 113 to the weighing hoppers 114 repeatedly, and still no combination is formed (steps S12, S17, and S3). Therefore, the all-drain process can be started in a constant manner. Accordingly, and problems such as the weighing device 110 repeating empty motion because the operator who has to start the all-drain process is not around can be avoided.

(4)

According to the device 1 of the present invention, the control device 50 determines the vertical length of the bag B automatically, based on a target measurement that the operator inputted in the operation environment setting in step S1. As the operator inputs the target measurement value for the kind of articles that is to be packed, the control device 50 automatically determines the length of the bag B to be produced by the packaging device 120, based on the target measurement value. Therefore, the operator does not need to input the size of the bag in the packaging device 120 separately. Accordingly, this device 1 can dispense with an additional process of inputting the size of bags. Moreover, the device 1 avoids problems due to incorrect input of bag size, such as inconsistency between the bag size and the target measurement value.

Second Embodiment

Although not mentioned in the above embodiment, when the weight of potato chips in a weighing hopper 118 exceeds a certain weight predetermined for the combination operation, an over scale error occurs in the control device 50. If the number of the weighing hoppers 118 in which the over scale error occurs is less than a predetermined value, the combination operation is often continued by using the remaining weighing hoppers 118. However, it is also possible to configure the device 1 so that once an over scale error occurs in one of the weighing hoppers 118, potato chips in the over scale weighing hopper 118 is immediately and compulsorily discharged and packed by the packaging device 120 as a defective product. Also, it is possible to configure the device 1 so that when the number of the weighing hoppers 118 in which an over scale error occurred exceeds the predetermined value, the potato chips in those weighing hoppers 118 are compulsorily discharged and packed by the packaging device 120 as defective products.

When the potato chips are compulsorily discharged due to the over scale error, data of the total weight of the potato chips compulsorily discharged are sent to the packaging control part 52 from the combination weight control part 51 via the main controlling part 53. The packaging control part 52 determines based on the data the length of a bag required for packaging the potato chips to be discarded. Accordingly, the potato chips compulsorily discharged from the weighing hoppers 118 will be packed in a bag having a size that is adjusted to the amount of the potato chips. In the case of the over scale error, since the total weight of an actual discharge may be larger than the data of the total weight transmitted to the packaging control part 52, a bag is often made larger.

In the error process, the articles in the weighing hoppers whose error have been detected are compulsory discharged. In the conventional art, a bag of predetermined size is formed when an ON/OFF signal that indicates an error from a weighing device. Therefore, the bag of the predetermined size may or may not be enough to contain all the articles being discharged. According to the device of the resent invention, the size of a bag produced in the packaging device 120 is determined by weight data obtained from the weighing device 110. Therefore, the amount of potato chips compulsorily discharged is reflected as the weight data in the bag producing process by the packaging device 120. Accordingly, the size of a bag can be optimized even when potato chips are compulsorily discharged due to over scale error. Therefore, a waste in consumption of a film can be avoided.

Third Embodiment

Although the length of a bag is determined after potato chips in all of the weighing hoppers 114 are discharged in the all-drain process as seen in FIG. 9, it is also possible to pack the potato chips in a plurality of bags having a predetermined size. In this case, the weight data is constantly monitored while potato chips are discharged from the weighing hoppers 114 one by one, such that all the potato chips compulsorily discharged are packed in a plurality of bags having a predetermined length.

Fourth Embodiment

Although the combination weight control part 51 of the weighing device 110 and the packaging control part 52 of the packaging device 120 are integrated in the above embodiment, it is possible, as in a conventional manner, to provide separate control parts for each of the devices 110 and 120. In this case, the weight data of potato chips is exchanged between the two control parts during the all-drain process or the zero point calibrating process, so that the control part of the packaging device can determine the size of a bag based on the weight data. That is, operations from the discharge of potato chips through the packaging thereof in the all-drain process or the zero point calibrating process can be carried out in an efficient manner as in the above-mentioned embodiment, even with the conventional system in which the weighing device 110 and the packaging device 120 have separate operation displays and control parts, as long as the control part of the packaging device 120 has an access to weight data of the weighing device 110.

Fifth Embodiment

Although the process automatically shifts to the all-drain process when the combination failure accumulation value E exceeds a predetermined value $E_{max}$, it is possible to use a timer so that the time to shift to the automatic shift to the all-drain process occurs is determined using time as a parameter.

Sixth Embodiment

Although the device 1 in the above-mentioned embodiment is a device used for measuring a certain weight of potato chips and packaging them in a bag, the application of the present invention is not limited to a device for weighing, discharging, and packaging a certain weight of articles. The present invention may be applied to a device in which a certain number of articles are discharged based on weight data of the articles to pack them in a bag.

Seventh Embodiment

Although the device in the aforementioned embodiment determines the length of a bag based on weight data of potato chips to be compulsorily discharged, it is possible to determine the length of a bag based on the volume data of articles. The volume data indicate the volume of the articles to be discharged. The volume data is calculated using pre-stored apparent specific gravity of the articles and weight data. The volume data are transferred to the packaging control part 52 from the combination weight control part 51 in the same manner as the weight data.

While seven embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

According to the present invention, the size of a bag produced can be adjusted to the amount of articles since the size of the bag is determined based on the weight data or volume data of the articles. Accordingly, problems such as producing a bag which is too large or too small for the amount of articles may be avoided. Additionally, the present invention dispenses with an operation in which an operator determines the size of a bag while watching the amount of articles. Hence, an efficient and secure operation of the packaging device can be achieved.

Further, since the weight of the articles discharged to the packaging device during the zero point calibrating process, the all-drain process, or the error process is not always within the predetermined range, bags of different sizes tend to be generated during these processes. Therefore, it is easy to distinguish bags produced in the normal operation from the ones produced in other processes. Accordingly, it is easy to remove the bags produced in other processes.

What is claimed is:

1. A weighing and packaging system, comprising:

a weighing device adapted to weigh articles and generate weight data of the articles;

a packaging device adapted to produce bags from a film and package the articles which have been weighed by said weighing device in the bags; and a controlling device for determining a size of the bags to be produced by said packaging device based on quantity data calculated from the weight data of the articles, and sending the size data to said packaging device.

2. The weighing and packaging system as set forth in claim 1, wherein said weighing device has a plurality of weighing hoppers for receiving the articles, carries out a combination operation by selecting a combination of said weighing hoppers based on the weight data of the articles in said weighing hoppers such that a total quantity of the articles in said combination of weighing hoppers is within a predetermined range, and discharges the articles in said combination of weighing hoppers.

3. The weighing and packaging system as set forth in claim 2, wherein said controlling device performs an error process in which articles in an error weighing hopper are discharged; and said controlling device during said error process designates said error weighing hopper and commands a discharge of the articles in said error weighing hopper, said controlling device determining the size of a bag to be produced by said packaging device based on the quantity data of the articles to be discharged.

4. The weighing and packaging system as set forth in claim 3, wherein said error weighing hopper is a weighing hopper that contains articles beyond the predetermined range.

5. The weighing and packaging system as set forth in claim 2, wherein said total quantity of the articles is configured in terms of the weight of the articles.

6. The weighing and packaging system as set forth in claim 2, wherein said total quantity of the articles is configured in terms of the number of the articles.

7. The weighing and packaging system as set forth in claim 1, wherein said weighing device has a plurality of weighing hoppers for receiving the articles;

said controlling device performs a zero point calibrating process; and said controlling device during said zero point calibrating process designates which of said weighing hoppers should be emptied and commands a discharge of the articles in said designated weighing hopper, determining the size of a bag to be produced by said packaging device based on the quantity data of the articles to be discharged.

8. The weighing and packaging system as set forth in claim 1, wherein said weighing device has a plurality of weighing hoppers for receiving the articles;

said controlling device performs an all-drain process in which the articles in all of said weighing device are discharged; and said controlling device during said all drain process commands a discharge of articles in all of said weighing hoppers and determines the size of a bag to be produced by said packaging device based on the quantity data of the articles to be discharged.

9. The weighing and packaging system as set forth in claim 1, wherein said controlling device determines the size of a bag to be produced in said packaging device based on a target quantity, the target quantity being inputted by an operator.

10. The weighing and packaging system as set forth in claim 9, wherein said weighing device has a plurality of weighing hoppers for receiving the articles, carries out combination operations based on the weight data of the articles put in said weighing hoppers, selects a combination of said weighing hoppers so that a total quantity of the articles in said combination of weighing hoppers is within a predetermined range including the target quantity, and discharges the articles in said combination of weighing hoppers.

11. The weighing and packaging system as set forth in any one of claims 1, wherein said packaging device is adapted to form a film into a cylindrically shaped bag aligned in a substantially vertical direction and having an upper opening, and to seal the upper opening after the articles are filled in the bag; and said controlling device determines the vertical length of the bag based on the quantity data.

12. The weighing and packaging system as set forth in claim 1, wherein said controlling device includes a first controlling part and a second controlling part, said first controlling part controlling said weighing device, said second controlling part controlling said packaging device; and the quantity data is transmitted from said first control part to said second control part.

13. The weighing and packaging system as set forth in claim 1, wherein the quantity data is weight data.

14. The weighing and packaging system as set forth in claim 1, wherein the quantity data is volume data calculated based on the weight data and a specific gravity of the articles.

15. A weighing and packaging system, comprising:

a weighing device adapted to weigh articles and generate weight data of the articles;

a packaging device adapted to produce bags from a film and package the articles which have been weighed by said weighing device in the bags; and a controlling device for adjusting a size of the bags to be produced in said packaging device based on quantity data calculated from the weight data of the articles and sending the size data to said packaging device, said controlling device being arranged to configure said weighing and packaging system in either normal operation state or special operation state.

16. The weighing and packaging system as set forth in claim 15, wherein said weighing device has a plurality of weighing hoppers for receiving the articles;

said weighing device is arranged to carry out a combination operation while said weighing and packaging system is in said normal operation state; and said weighing device during said combination operation selects a combination of said weighing hoppers based on the weight data of the articles in said weighing hoppers so that a total quantity of the articles in said combination of weighing hoppers is within a predetermined range, and discharges the articles in said combination of weighing hoppers.

17. The weighing and packaging system as set forth in claim 15, wherein said weighing device has a plurality of weighing hoppers for receiving the articles;

said controlling device is arranged to carry out a zero point calibrating process while said weighing and packaging system is in said special operation state; and said controlling device during said zero point calibrating process designates which of said weighing hoppers should be emptied, commands a discharge of the articles in said designated weighing hopper to empty said designated weighing hopper, and stores the weight of an empty weighing hopper as a zero point, determining the size of a bag to be produced by said packaging device based on the quantity data of the articles to be discharged.

18. The weighing and packaging system as set forth in claim 15, wherein said weighing device has a plurality of weighing hoppers for receiving the articles;

said controlling device is arranged to carry out an all-drain process while said weighing and packaging system is in said special operation state; and said controlling device during said all-drain process commands a discharge of articles in all of said weighing hoppers to discharge articles in all of said weighing device, and determines the size of a bag to be produced by said packaging device based on the quantity data of the articles to be discharged.

19. The weighing and packaging system as set forth in claim 18, wherein said controlling device is arranged to start said all-drain process automatically as said weighing and packaging system meets a predetermined criterion.

20. The weighing and packaging system as set forth in claim 18, wherein said controlling device is arranged to start said all-drain process every predetermined period of time.

21. The weighing and packaging system as set forth in claim 15, wherein said weighing device has a plurality of weighing hoppers for receiving the articles;

said controlling device is arranged to start an error process while said weighing and packaging system is in said special operation state; and said controlling device during said error process articles designates an error weighing hopper, commands a discharge of the articles in said error weighing hopper to discharge articles in said error weighing hopper, and determines the size of a bag to be produced by said packaging device based on the quantity data of the articles to be discharged.

22. The weighing and packaging system as set forth in claim 15, wherein said weighing device has a plurality of weighing hoppers for receiving the articles;

said controlling device is arranged to carry out an all-drain process while said weighing and packaging system is in said special operation state; and said controlling device during said all-drain process commands a discharge of articles in all of said weighing hoppers to discharge articles in all of said weighing hoppers, and determines the number of bags having a predetermined size to be produced by said packaging device based on the quantity data of the articles to be discharged.

* * * * *